US006006378A

United States Patent [19]

Hayashi

[11] Patent Number: 6,006,378

[45] Date of Patent: Dec. 28, 1999

[54] BED CAPABLE OF READY BEDCLOTH CHANGING WITHOUT MOVING A PERSON THEREON

[76] Inventor: Mitsuru Hayashi, 2-20-5, Hatsuyama, Miyamae-ku, Kawasaki-shi, Kanagawa, Japan

[21] Appl. No.: 09/150,054

[22] Filed: Sep. 9, 1998

[30] Foreign Application Priority Data

Apr. 14, 1998 [JP] Japan ..... 10-102567

[51] Int. Cl.[6] ..... A47C 21/02

[52] U.S. Cl. ..... 5/488; 5/692; 5/611; 5/612; 5/11; 5/81.1 HS

[58] Field of Search ..... 5/488, 692, 612, 5/611, 11, 81.1 C, 81.1 HS

[56] References Cited

U.S. PATENT DOCUMENTS

| | | | |
|---|---|---|---|
| 3,388,406 | 6/1968 | Scrivener | 5/488 |
| 5,265,296 | 11/1993 | Abbas et al. | 5/488 X |
| 5,659,905 | 8/1997 | Palmer, Jr. et al. | 5/612 X |
| 5,718,009 | 2/1998 | Lin | 5/488 X |
| 5,850,642 | 12/1998 | Foster | 5/81.1 C |
| 5,913,773 | 6/1999 | Cox | 5/488 X |
| 5,933,884 | 8/1999 | Shikinami et al. | 5/81.1 HS |

FOREIGN PATENT DOCUMENTS

| | | | |
|---|---|---|---|
| 2428997 | 2/1980 | France | 5/488 |

*Primary Examiner*—Terry Lee Melius
*Assistant Examiner*—Rodrigo J. Morales
*Attorney, Agent, or Firm*—Ostrolenk, Faber, Gerb & Soffen, LLP

[57] ABSTRACT

A bed permits changing of bedclothes without moving the person on it and without substantial burden for either the patient or the care-taker. A left and a right carriage member 5 and 6, wheels 15 to 18 and a shaft 7 constitute a carriage. The carriage supports mats 11 and 12 via balancing members 3 and 4 and shafts 1 and 2 and advances the mats 11 and 12 along rails 31 and 32. The mat 12 is stretched between the rails 31 and 32 by fasteners. The balancing members 3 and 4 are rotatably coupled by a shaft to downward extensions 5*a* and 6*a* of the carriage members 5 and 6. The shafts 1 and 2 are rotatably mounted in the balancing members 3 and 4. With advancement of the carriage caused by turning a grip 26, the slides 52 and 54 cause the old mat 12 to be released from the fasteners and wound on the shaft 2, while also causing the new mat 11 to be coupled to the fasteners and stretched between the rails 31 and 32.

25 Claims, 18 Drawing Sheets

BED CAPABLE OF READY BEDCLOTH CHANGING WITHOUT MOVING A PERSON THEREON

BACKGROUND OF THE INVENTION

The present invention relates to beds which are suitable for care-taking of sick persons and old persons who cannot get out of bed by themselves and, more particularly, to a bed, which permits changing bedclothes such as the sheet, mat, bedspread, etc., without moving the person on it.

In the caretaking of a sick person who cannot get out of bed by himself or herself, it is a great burden to change bedclothes such as the sheet, mat and bedspread, which requires much physical power and may cause damage to the waist Accordingly, various methods of changing bedclothes without moving the person on the bed have been proposed. For the sake of brevity of the description, the area where bedclothes are spread is referred to as the bedclothes spreading area, bedclothes which are spread on the bedclothes spreading area and to be changed are referred to as old bedclothes, and bedclothes for use to change the old bedclothes are referred to as new bedclothes.

In one conventional bedclothes changing method, the patient on the old bedclothes is once moved to the left, then the old bedclothes spread on a right area of the bed are wound to leave that area empty, then new bedclothes are spread on the empty area, then the patient is rotated by one rotation over the wound old bedclothes and a wound part of the new bedclothes to the spread part thereof, then the old bedclothes are removed, then the wound part of the new bedclothes are on the left area of the bed, and then the patient is positioned at the center of the bed, thus bringing an end to the bedclothes changing process.

In the above prior art bedclothes change method, the patient has to be moved over the bedclothes spreading area, which is again a great burden for the patient and the care-taker.

SUMMARY OF THE INVENTION

An object of the present invention, accordingly, is to provide a bed which permits ready bedclothes changing without moving the person on the bed and thus with substantial burden on neither the patient nor the care-taker.

According to the present invention, there is provided a bed which permits the changing of bedclothes without moving the person on it. Referring to a rectangular, horizontal plan area on which bedclothes are to be spread over as a bedclothes spreading area, bedclothes already spread on the bedclothes spreading area and to be changed are old bedclothes. Bedclothes to be newly spread on the bedclothes spreading area in place of the old bedclothes are new bedclothes. The old bedclothes are removed during the changing process by a leading end thereof in the longitudinal direction thereof. Similarly, a leading end of the new bedclothes in the longitudinal direction thereof is spread on the bedclothes spreading area. In this regard, the present invention comprises:

a first shaft with the new bedclothes wound thereon such that the leading end thereof is the outermost free end;

a second shaft for taking up the old bedclothes from the leading end thereof;

shaft holding means for holding the first and second shafts such that these shafts are independently rotatable, parallel to each other, spaced apart a predetermined distance and positioned underneath the bedclothes spreading area;

guiding means for guiding the shaft holding means along a first and a second parallel guide extending under and on the opposite sides of the bedclothes spreading area;

stretching means supported inside the first and second guides by the guiding means, for detachably spreading the bedclothes over the bedclothes spreading area; and rotating means for rotating the second shaft;

wherein in a state in which the leading end of the old bedclothes is tied to the second shaft and the leading end of the new bedclothes is held stretched in the stretching means, and in which a pulling force or tension is applied to the old bedclothes by rotating the second shaft with the rotating means, the old bedclothes are wound on the second shaft, while causing, with the reaction force of the pulling force or tension, the shaft holding means to be moved along the guides, thereby causing the new bedclothes being paid out from the first shaft to be spread and stretched by the stretching means over the empty area formed in the bedclothes spreading area as the old bedclothes are wound on the second shaft.

The guiding means includes a first rail and a second rail and rail support means supporting the rails;

the first and second rails constitute the first and second guides, respectively;

the first and second rails have a length greater than the long edges of the bedclothes spreading area;

the rail support means support the guides such that the guides are located on the outer side of and parallel to the long edges of the bedclothes spreading area and support the first and second rails such that these rails are spaced apart a distance greater than the short edges of the bedclothes spreading area;

the shaft holding means includes a carriage and a first and a second balancing member;

the carriage includes a first carriage member which is guided along the first guide, and a second carriage member which is guided along the second guide;

the first balancing member is coupled by rotational coupling to the first carriage member such as to be pivotal about a third shaft the axis of which is perpendicular to the direction of guiding along the guides;

the second balancing member is coupled by rotational coupling to the second carriage member such as to be pivotal about a fourth shaft, the axis of which is aligned with the axis of the third shaft, and is further coupled by the first and second shafts to the first balancing member, the first and second shafts being spaced apart and parallel to the third shaft; and the stretching means is a fastener means.

The fastener means includes a first fastener formed in the proximity of the first guide and a second fastener formed in the proximity the second guide;

the first fastener includes a fastener tape secured to the first rail and another fastener tape tied to or constituted by an edge of bedclothes;

the second fastener includes a fastener tape secured to the second rail and another fastener tape tied to or constituted by an edge of bedclothes;

a first slide and a second slide are coupled via a first and second slide coupling means, respectively, to the first carriage member;

a third slide and a fourth slide are coupled via a third and a fourth slide coupling means, respectively, to the second carriage member;

the first slide meshes fastener teeth trains of the rail side and old bedclothes side fastener tapes of the first fastener with each other as the first carriage member is advanced along the first guide by the reaction force of the pulling force or tension;

the second slide de-meshes fastener teeth trains of the rail side and new bedclothes side fastener tapes of the first fastener from each other as the first carriage member is advanced along the first guide by the reaction force of the pulling force or tension;

the third slide meshes fastener teeth trains of the rail side and old bedclothes side fastener tapes of the second fastener with each other as the second carriage member is advanced along the second guide by the reaction force of the pulling force or tension; and the fourth slide de-meshes fastener teeth trains of the rail side and new bedclothes side fastener tapes of the second fastener from each other as the second carriage member is moved along the second guide by the reaction force of the pulling force or tension.

A lower support structure is provided underneath the bedclothes spreading area;

the lower support structure includes a mattress having substantially the same shape as the bedclothes spreading area, a mattress support structure for supporting the bottom of the mattress, and lifting means for vertically moving the mattress support structure;

the lifting means is able to vertically move the mattress support structure while holding the top surface of the mattress horizontal; and the distance moved by the top of the mattress in vertical movement thereof caused by the lifting means via the mattress support structure covers at least a range between the lower surface of the bedclothes stretched over the bedclothes spreading area by the stretching means and the lowest surface of a roll of the new bedclothes wound on the first shaft.

The carriage includes a fifth shaft parallel to the first shaft and a cylindrical cushioning member enclosing the fifth shaft;

the first shaft couples together the first and second carriage members; and the fifth shaft is disposed at a position that the top of the cushioning member occupies a central part of a free space formed between the old and new bedclothes in the bedclothes spreading area while the first and second carriage members are advanced along the first and second guides by the reaction force of the pulling force and tension.

A sheet of a liquid-tight material, such as vinyl chloride, may be provided for covering the top of the new bedclothes and being spread together with the bedclothes on the bedclothes spreading area, along with tying means for tying the edges of the sheet spread on the bedclothes to the first and second rails;

the sheet having a size such that when the edges thereof are tied by the tying means, the sheet can be held at the level of the bedclothes spreading area in a second state brought about from a first state;

the first state being brought about by lifting the mattress with the lower support structure until the top of the mattress comes to a position to support the bottom of the bedclothes spread on the bedclothes spreading area, then tying the edges of the sheet spread on the top of the bedclothes to the first and second rails with the tying means, and then unfastening the first and second fasteners;

the second state being brought about by forming a recess like a bath tub with the sheet by lowering the mattress via the lower support structure, and then pouring water into the recess to bring the bottom thereof to a position at least 20 centimeters below the bedclothes spreading area.

A sheet of a liquid-tight material, such as vinyl chloride, may be provided for covering the top of the new bedclothes and being spread together with the bedclothes on the bedclothes spreading area, along with sheet edge supporting means for supporting the edges of the sheet spread on the top of the bedclothes at a level at least 20 centimeters above the bedclothes spreading area;

the sheet edge supporting means including a first to a fourth support post having stem members secured to the opposite ends of the first and second rails, and tying means for tying the edges of the sheet to the upper ends of the first to fourth support posts;

the first to fourth support posts having a height of at least 20 centimeters and being capable of being detachably mounted on the opposite ends of the first and second rails, the stem members being capable of being mounted on the opposite ends.

Other objects and features will be clarified from the following description with reference to attached drawings.

BRIEF DESCRIPTION OF THE DRAWINGS

FIGS. 1(A) and 1(B) to FIG. 3 show a first embodiment of the present invention in a state thereof in which all bedclothes are spread on one half of a bedclothes spreading area and in which new bedclothes are spread on the remaining half of the spreading area;

FIGS. 6(A) and 6(B) to FIG. 8 show the first embodiment of the present invention in regular use in which a patient is laid on bedclothes spread on the bedclothes spreading area;

FIGS. 9(A) and 9(B) to FIG. 11 show the first embodiment of the present invention in a state thereof in which a mat (i.e., old bedclothes) 12 spread in the bedclothes spreading area is about to be taken up on a shaft 2 with its leading edge secured thereto and in which another mat 11 wound on a shaft 1 is about to be spread on the bedclothes spreading area with its leading edge secured to an end of the bedclothes spreading area in the longitudinal direction thereof;

FIGS. 12(A) and 12(B) to FIG. 14 show the first embodiment of the present invention in a state thereof in which the mat 12 that was previously spread on the bedclothes spreading area has been taken up on the shaft 2 and in which the mat 11 which was wound on the shaft 1 has been paid out in the same amount and spread on the bedclothes spreading area;

PREFERRED EMBODIMENTS OF THE INVENTION

Preferred embodiments of the present invention will now be described with reference to the drawings.

Figure 1A:
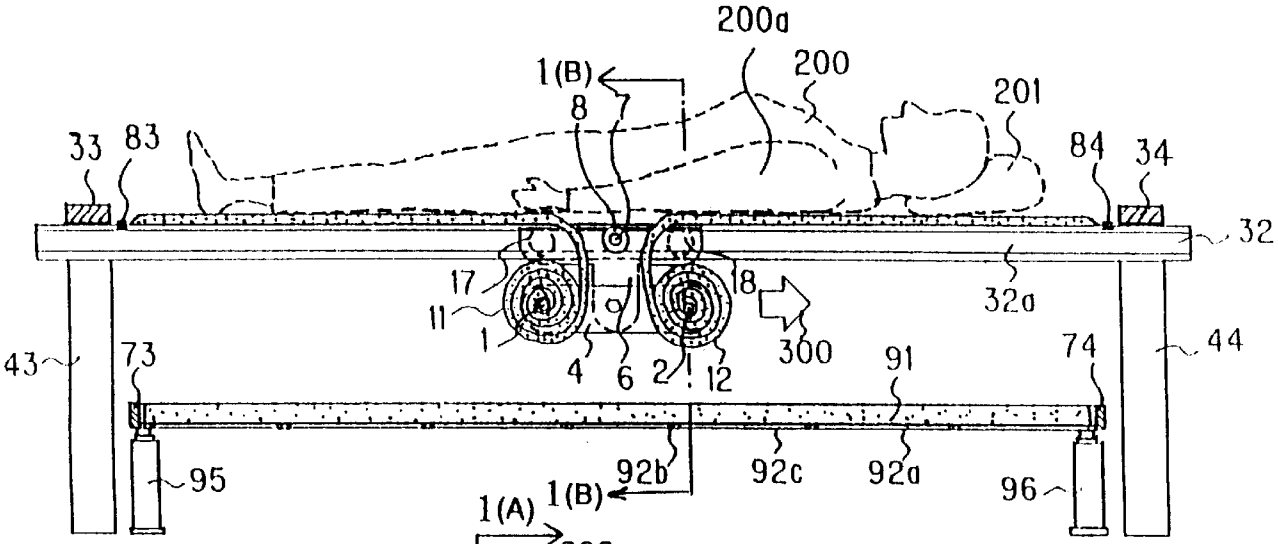
Figure 1B:
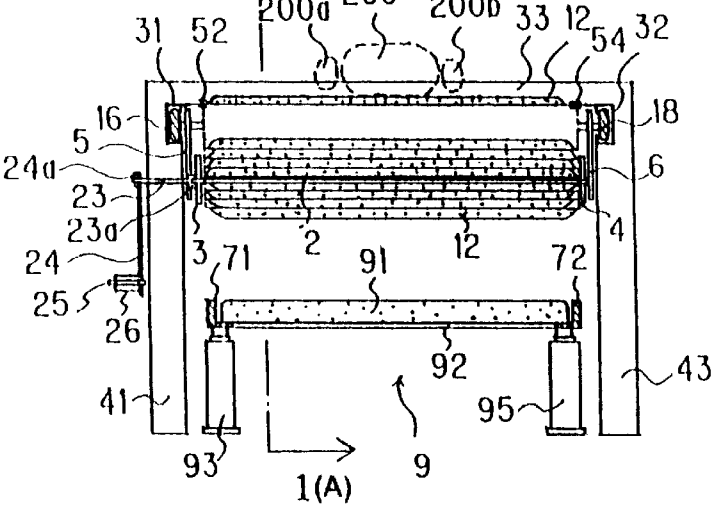
Figure 2A:
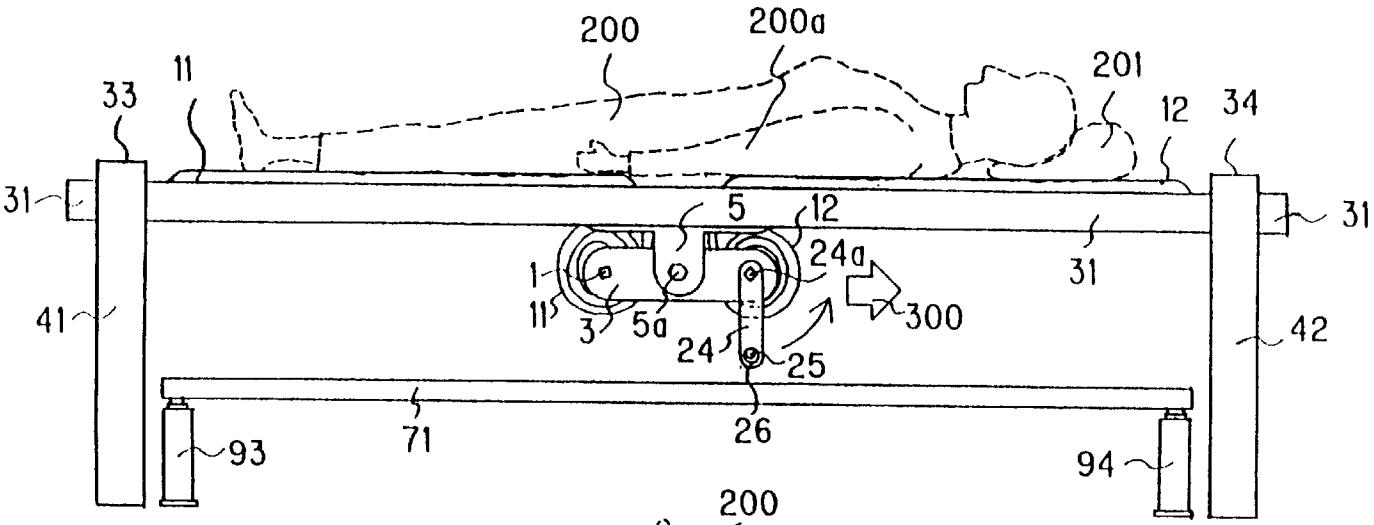
Figure 2B:
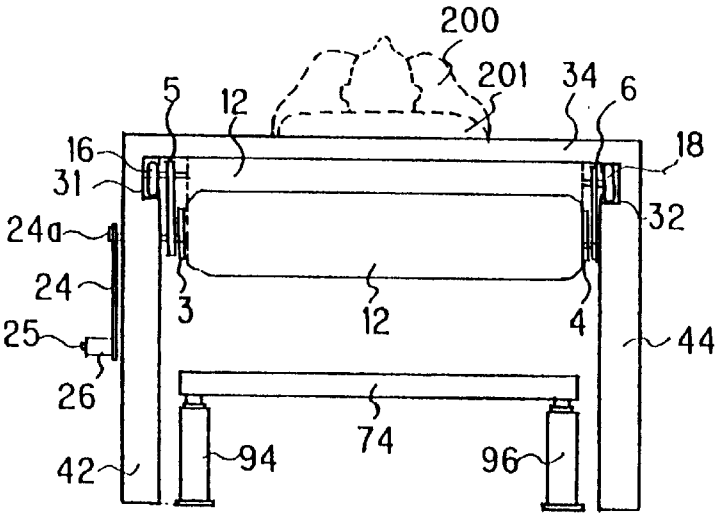
Figure 3:
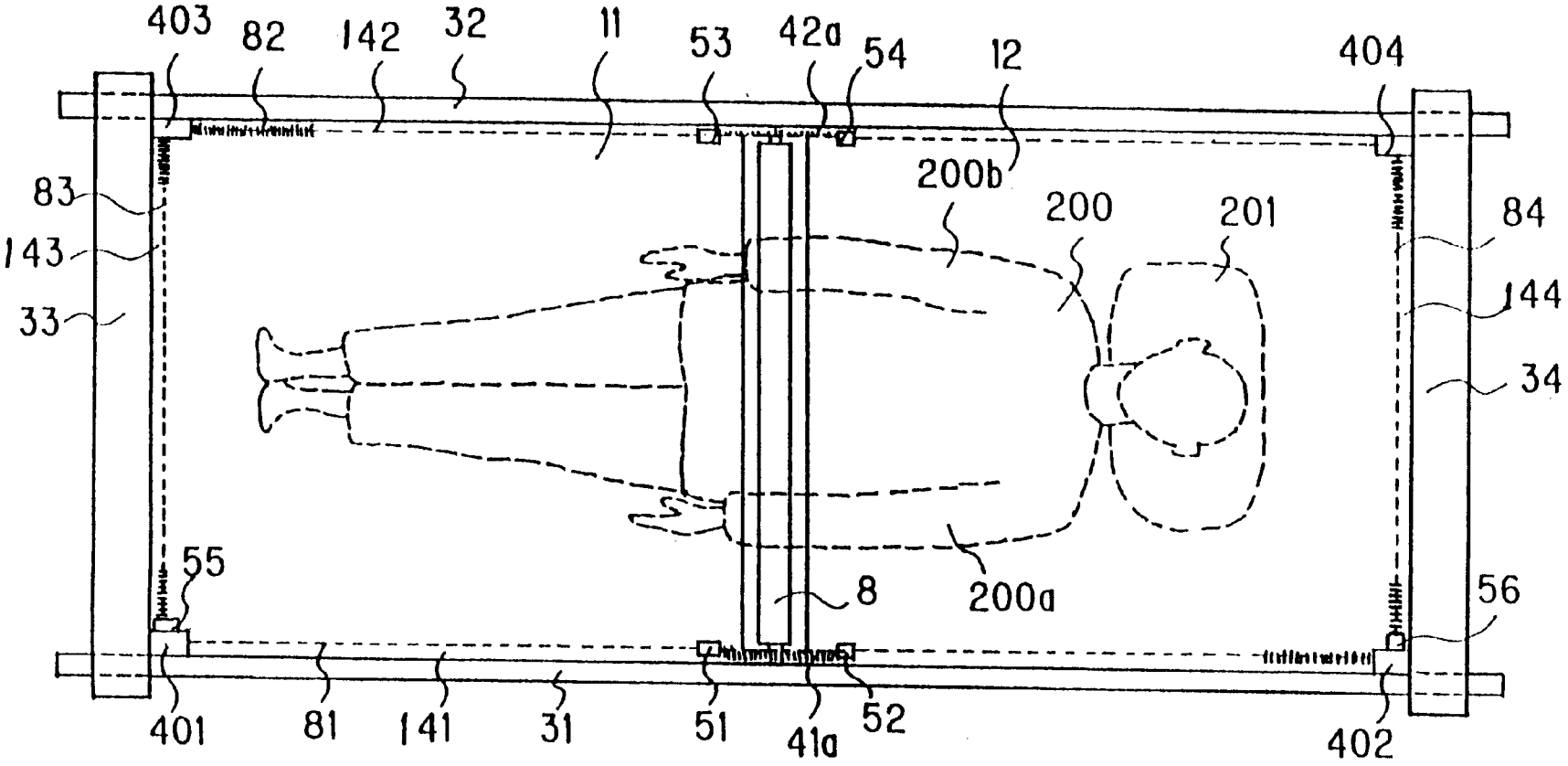

FIGS. 1(A) and 1(B) to FIG. 3 show a first embodiment of the present invention in a state thereof in which old bedclothes are spread on one half of a bedclothes spreading area and in which new bedclothes are spread on the remaining half of the spreading area, FIG. 1(A) being a longitudinal sectional view FIG. 1(B) a transversal sectional view, FIG. 2(A) a left side view, FIG. 2(B) a front view, and FIG. 3 a plan view.

Figures 4A, 4B, 4C:
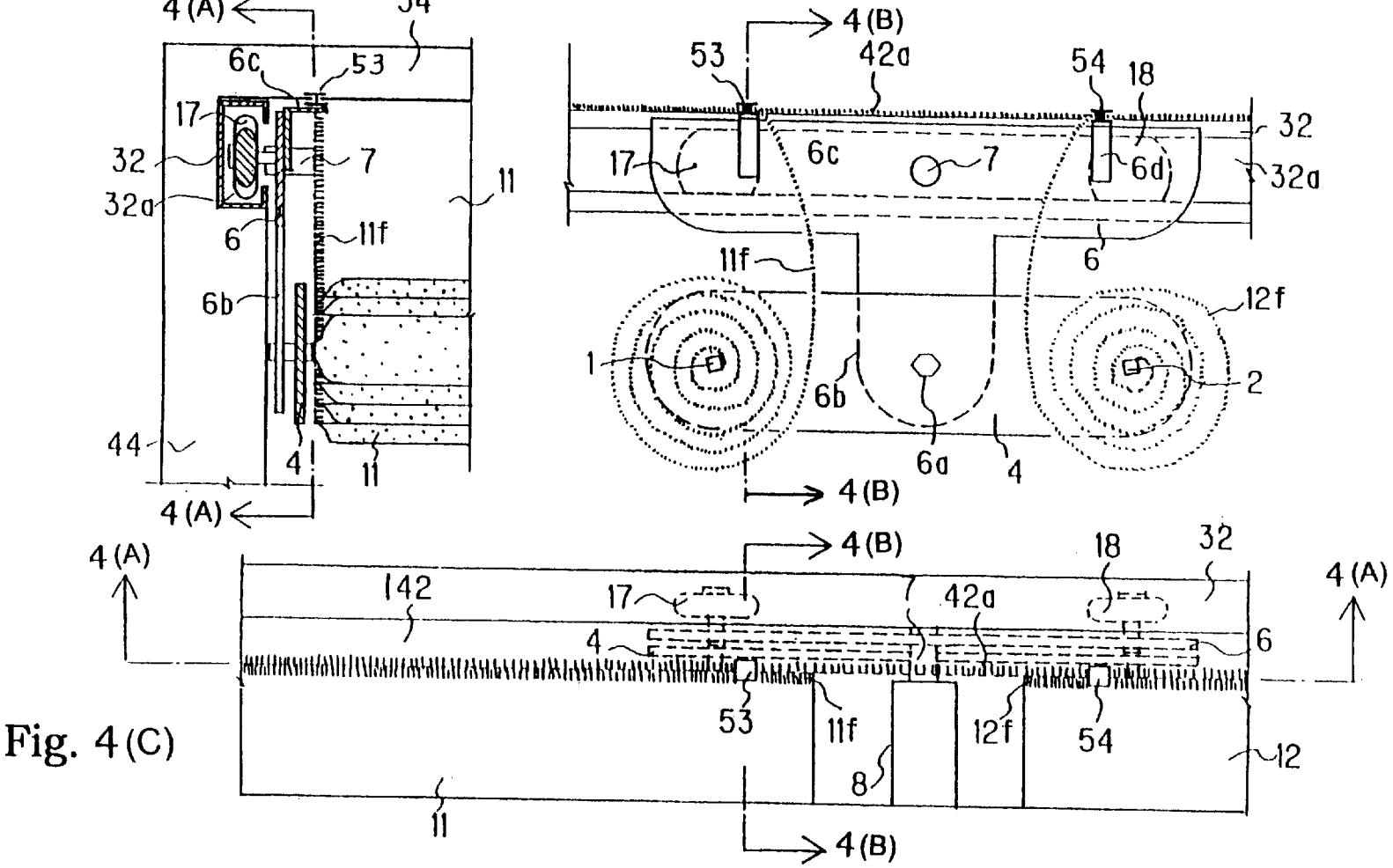
FIGS. 4(A) to 4(C) show, to an enlarged scale, an essential part of the embodiment shown in FIGS. 1(A) and 1(B) to FIG. 3.
Figure 5A:
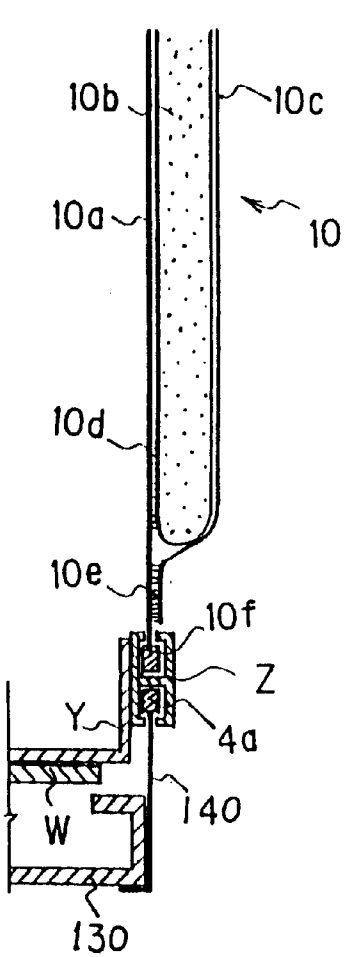
FIGS. 5(A) to 5(C) show, to an enlarged scale, an essential part of the embodiment shown in FIGS. 1(A) and 1(B) to FIG. 3.
Figure 5B:
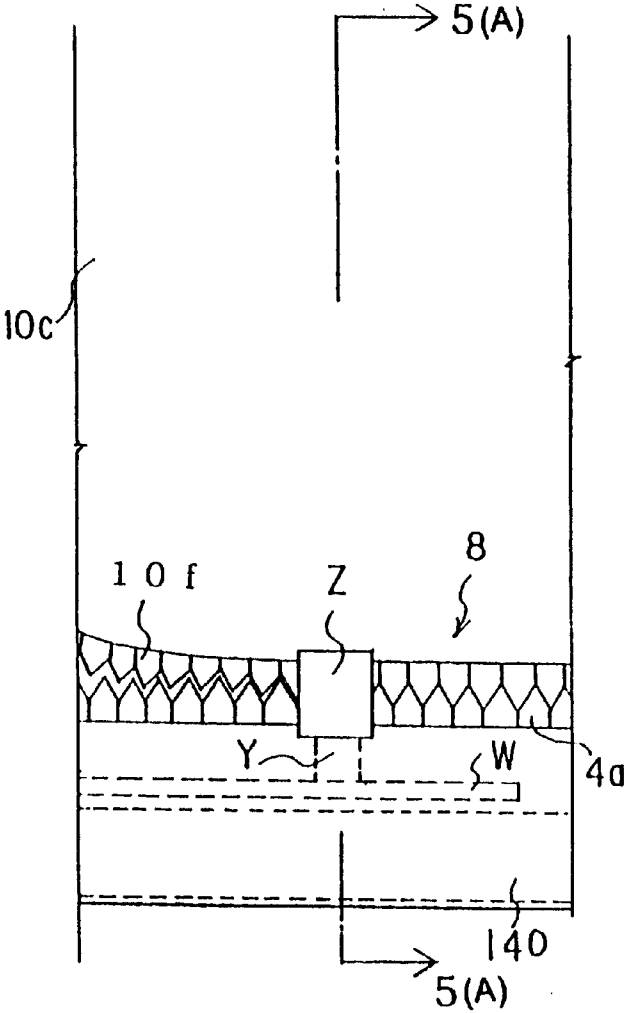
Figure 5C:
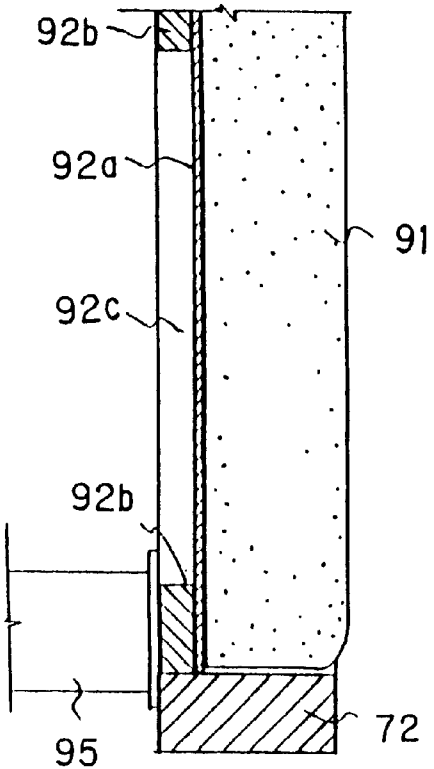

FIGS. 4(A) to 4(C) show, to an enlarged scale, an essential part of the embodiment shown in FIGS. 1(A) and 1(B) to FIG. 3, FIG. 4(A) being a longitudinal sectional view, FIG. 4(B) a transversal sectional view, FIG. 4(C) a plan view, FIGS. 5(A) to 5(C) show, to an enlarged scale, an essential part of the embodiment shown in FIGS. 1(A) and 1(B) to 3, FIG. 5(A) being a transversal sectional view, FIG. 5(B) a plan view, FIG. 5(C) a longitudinal sectional view.

Figure 6A:
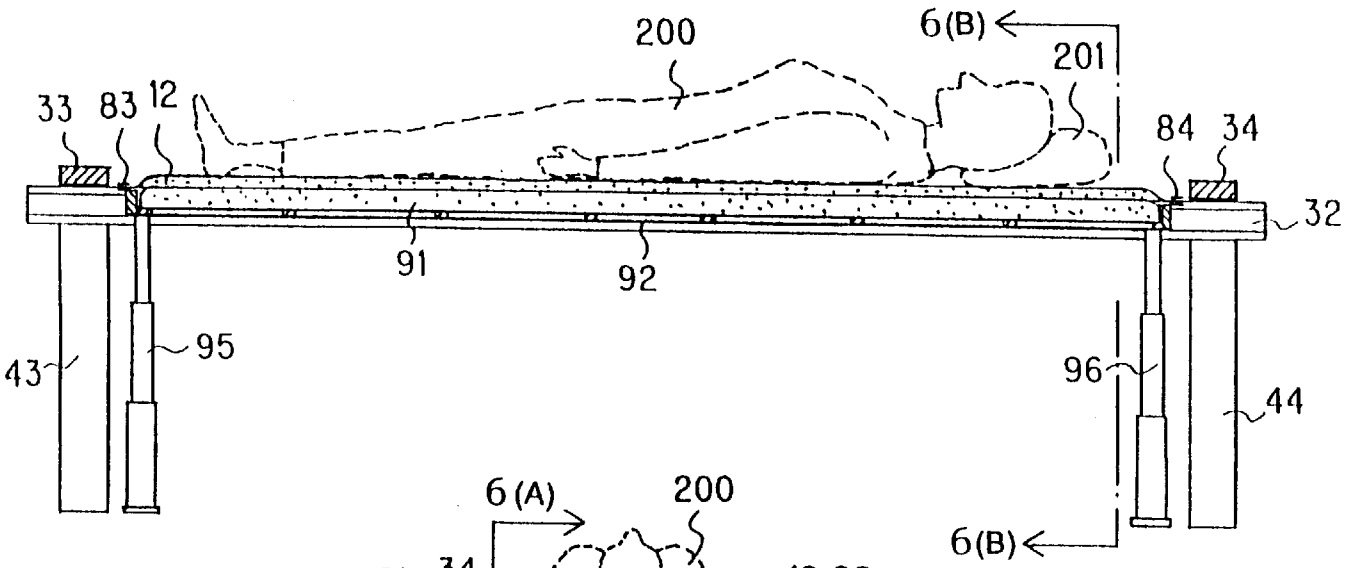
Figure 6B:
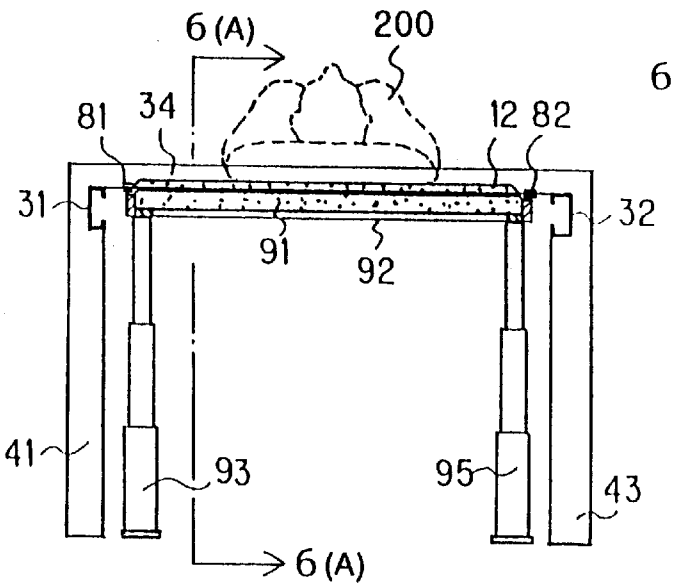
Figure 7:
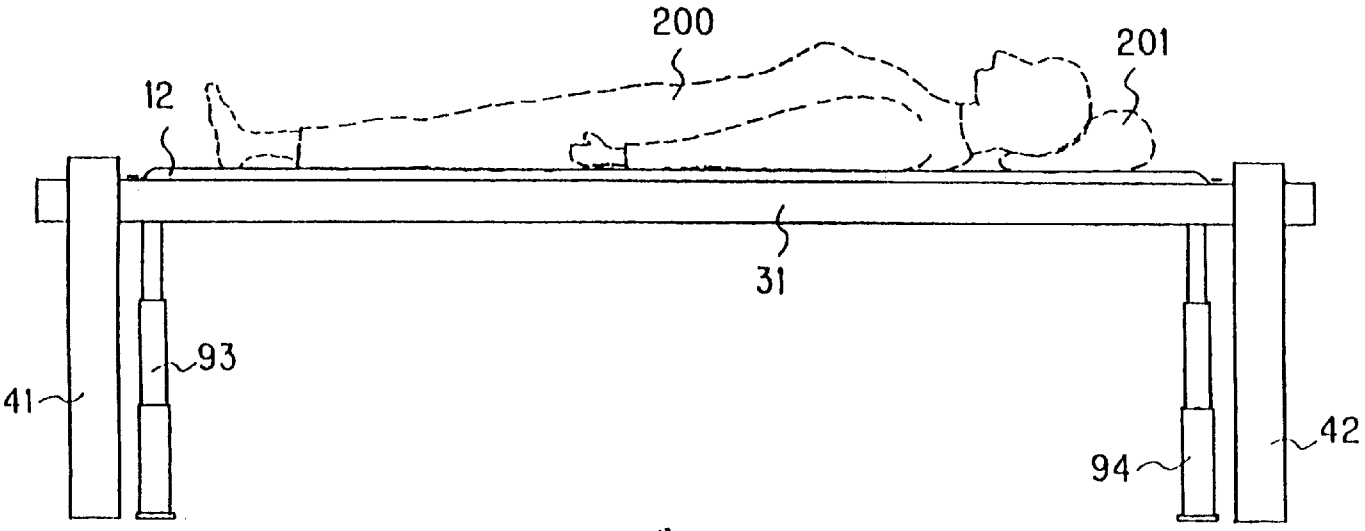
Figure 7B:
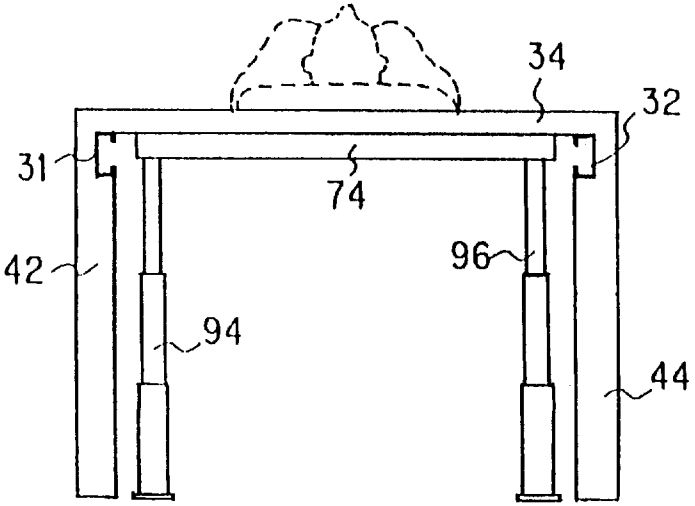
Figure 8:
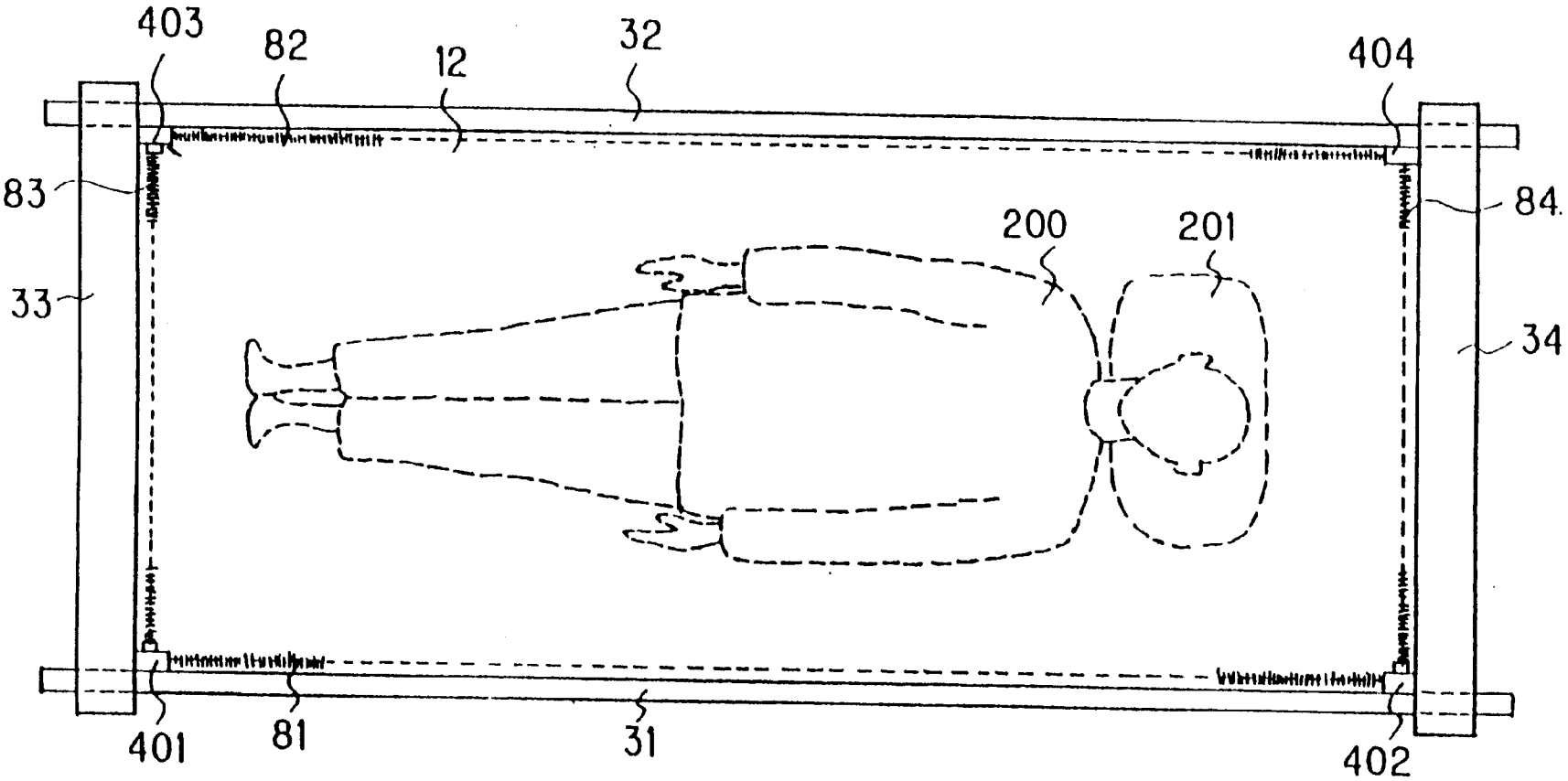

FIGS. 6(A) and 6(B) to FIG. 8 show the first embodiment of the present invention in regular use in which a patient is laid on bedclothes spread on the bedclothes spreading area, FIG. 6(A) being a longitudinal sectional view, FIG. 6(B) a transversal sectional view, FIG. 7(A) a left side view, FIG. 7(B) a front view, FIG. 8 a plan view. The state of the first embodiment of the bed according to the present invention as shown in FIGS. 6(A) and 6(B) to FIG. 8, is right before the beginning of and also right after the completion of the bedclothes change.

Figure 9A:
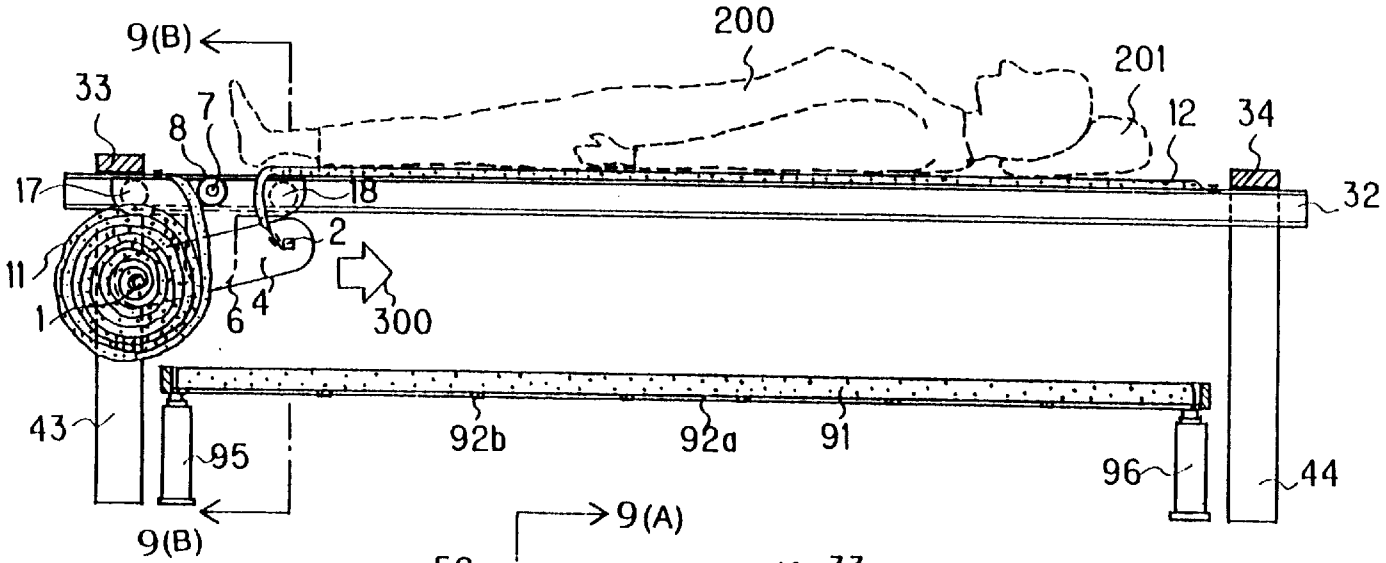
Figure 9B:
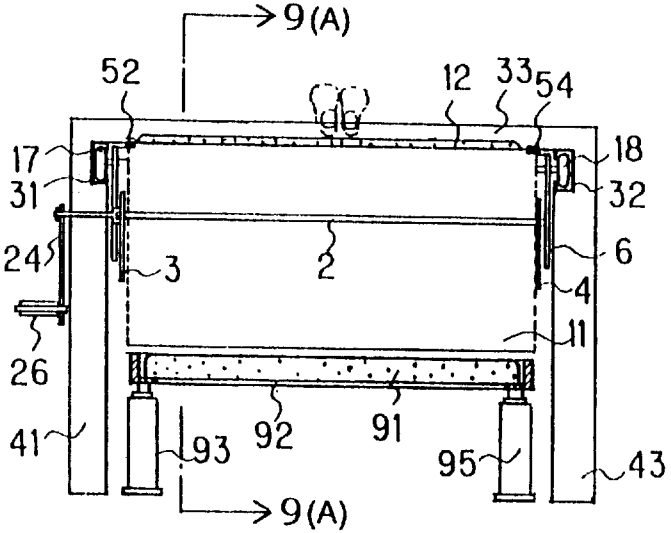
Figure 10A:
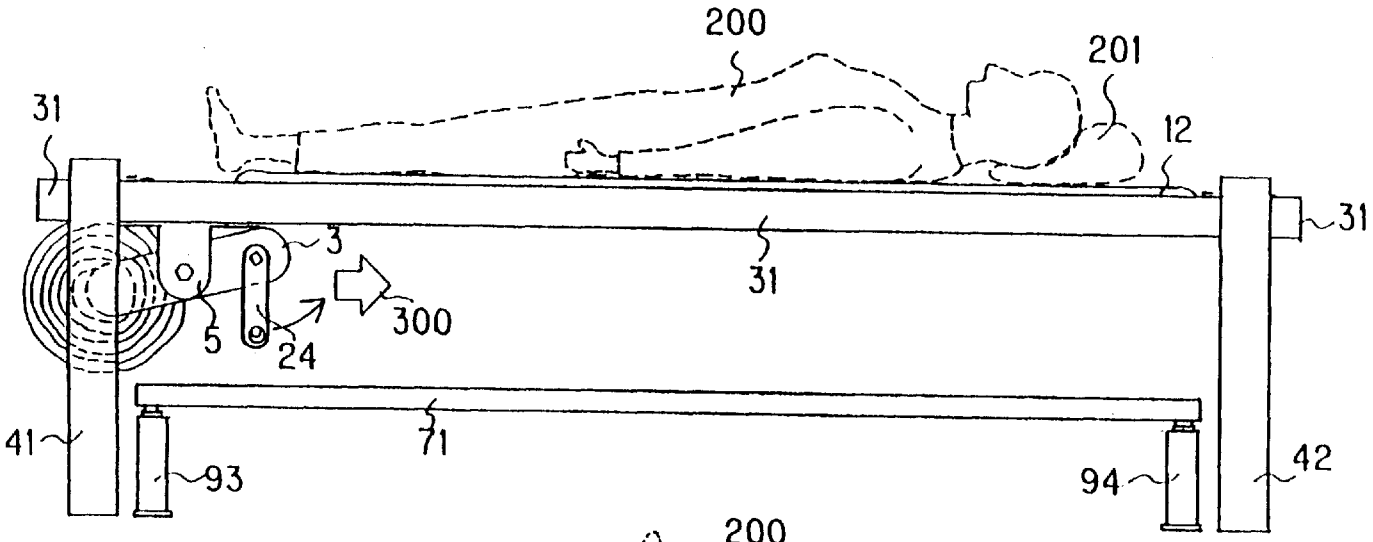
Figure 10B:
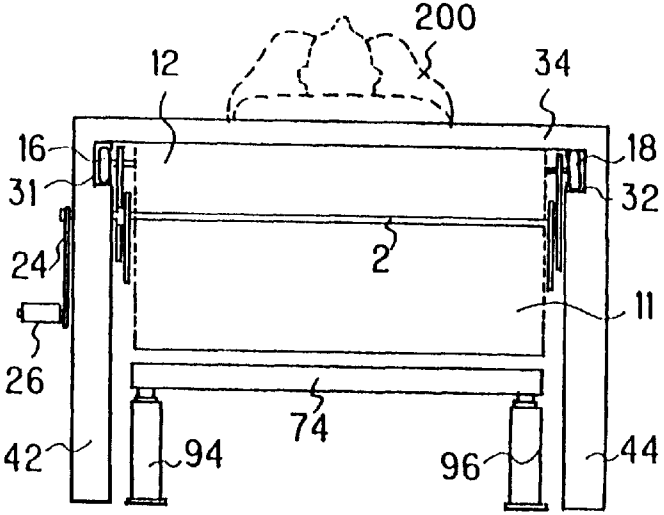
Figure 11:
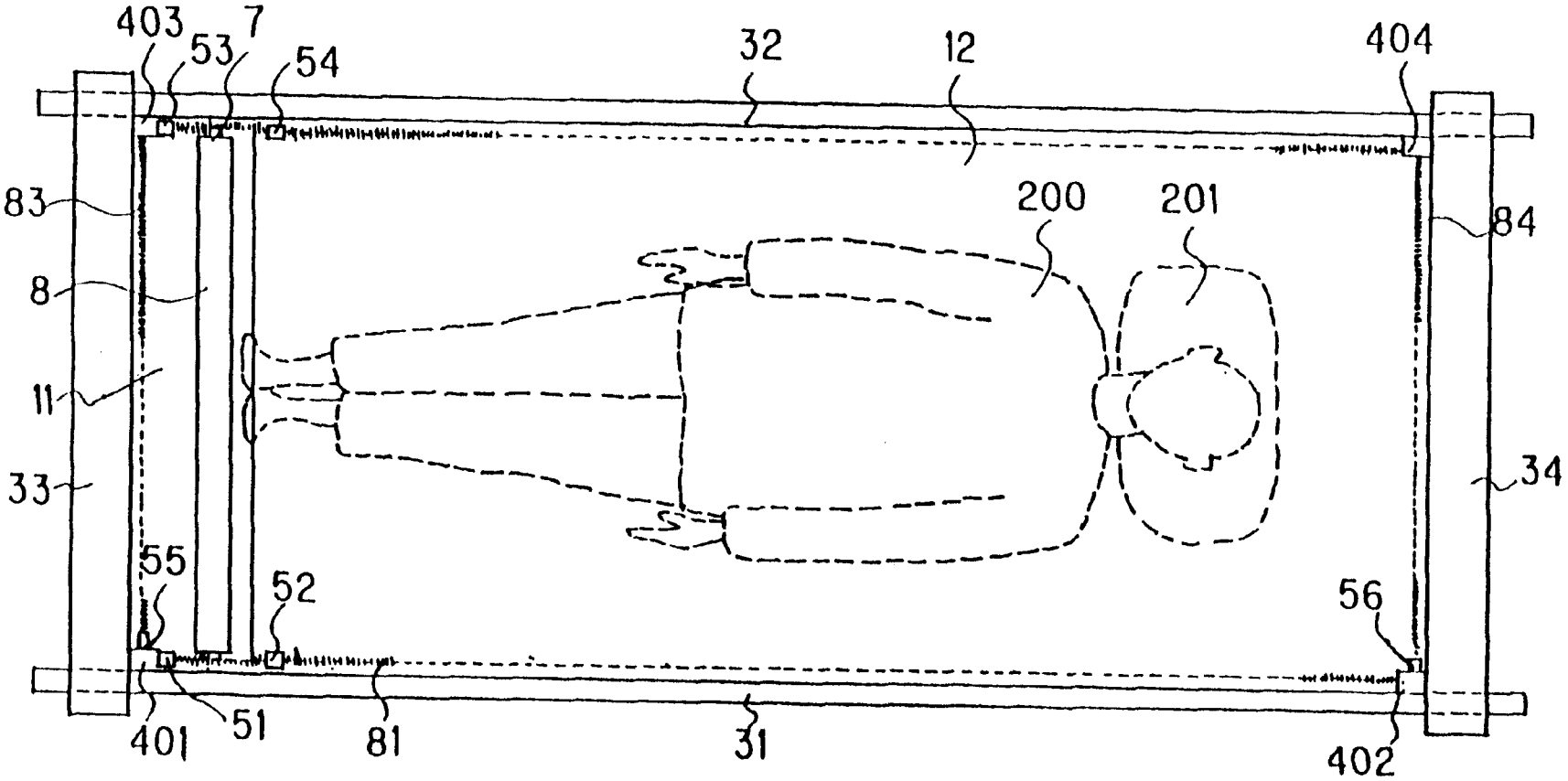

FIGS. 9(A) and 9(B) to FIG. 11 show the first embodiment of the present invention in a state thereof in which a mat (i.e., old bedclothes) 12 spread on the bedclothes spreading area is about to be taken up on a shaft 2 with its leading edge secured thereto and in which another mat (i.e., new bedclothes) 11 wound on a shaft 1 is about to be spread on the bedclothes spreading area with its leading edge secured to an end of the bedclothes spreading area in the longitudinal direction thereof, FIG. 9(A) being a longitudinal sectional view, FIG. 9(B) a transversal sectional view, FIG. 10(A) a left side view, FIG. 10(B) a front view, and FIG. 11 a plan view.

Figures 12A, 12B:
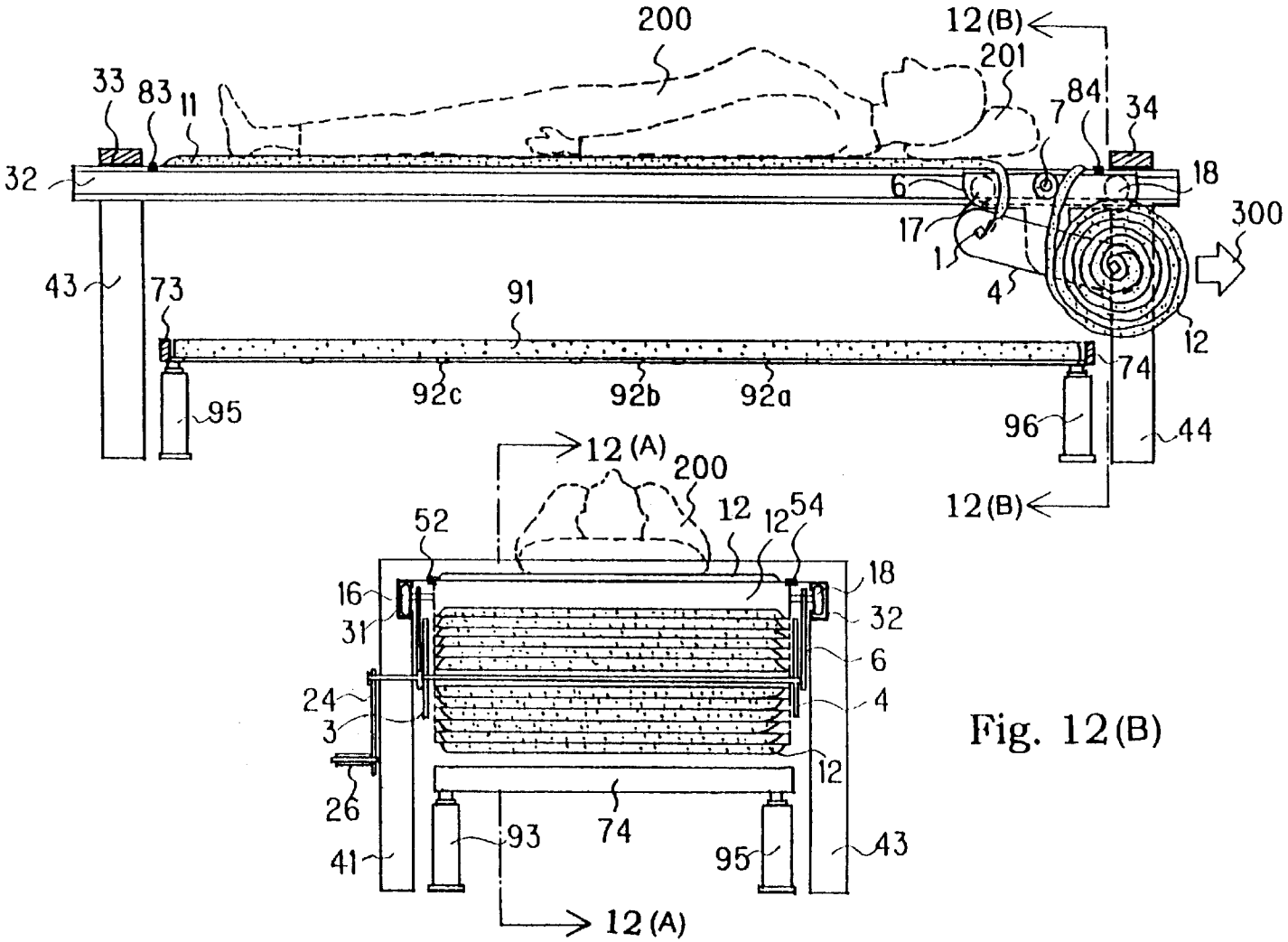
Figure 13:
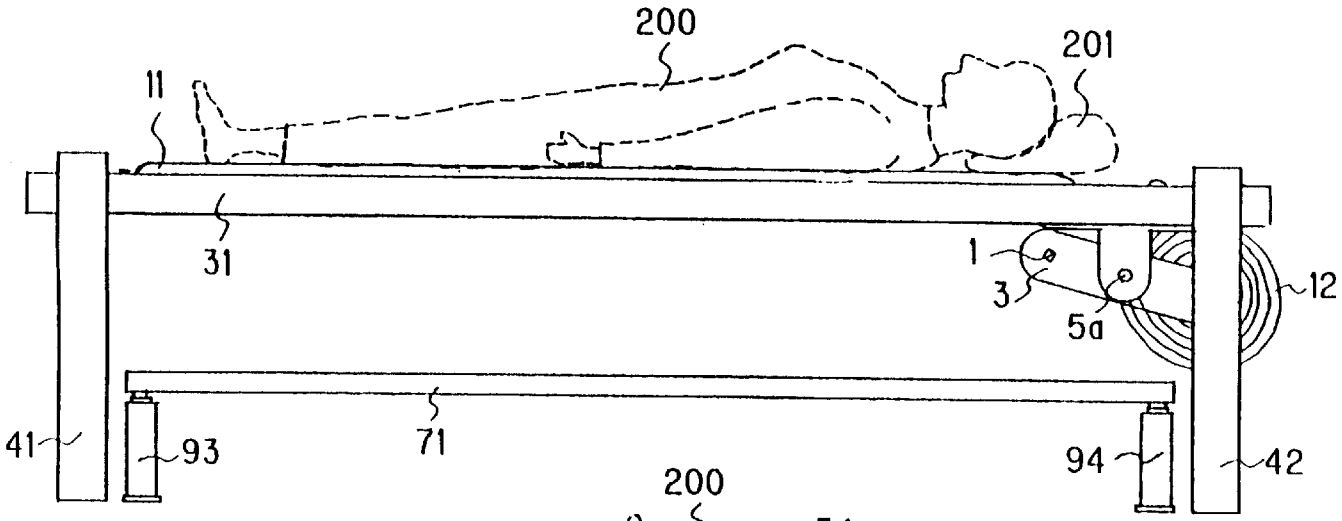
Figure 13B:
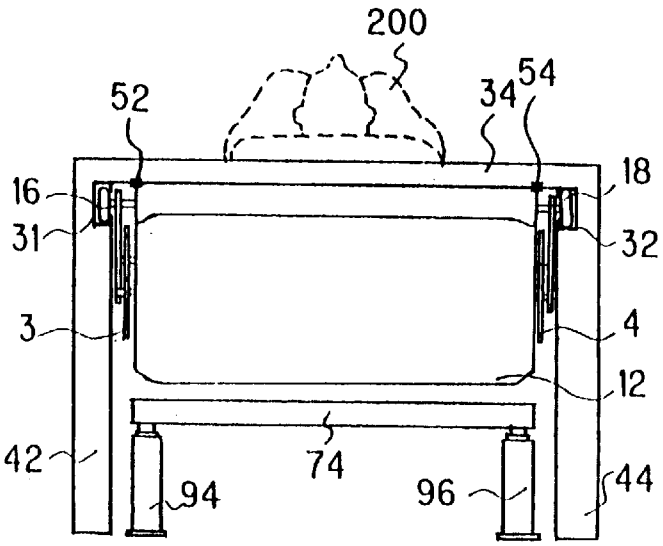
Figure 14:
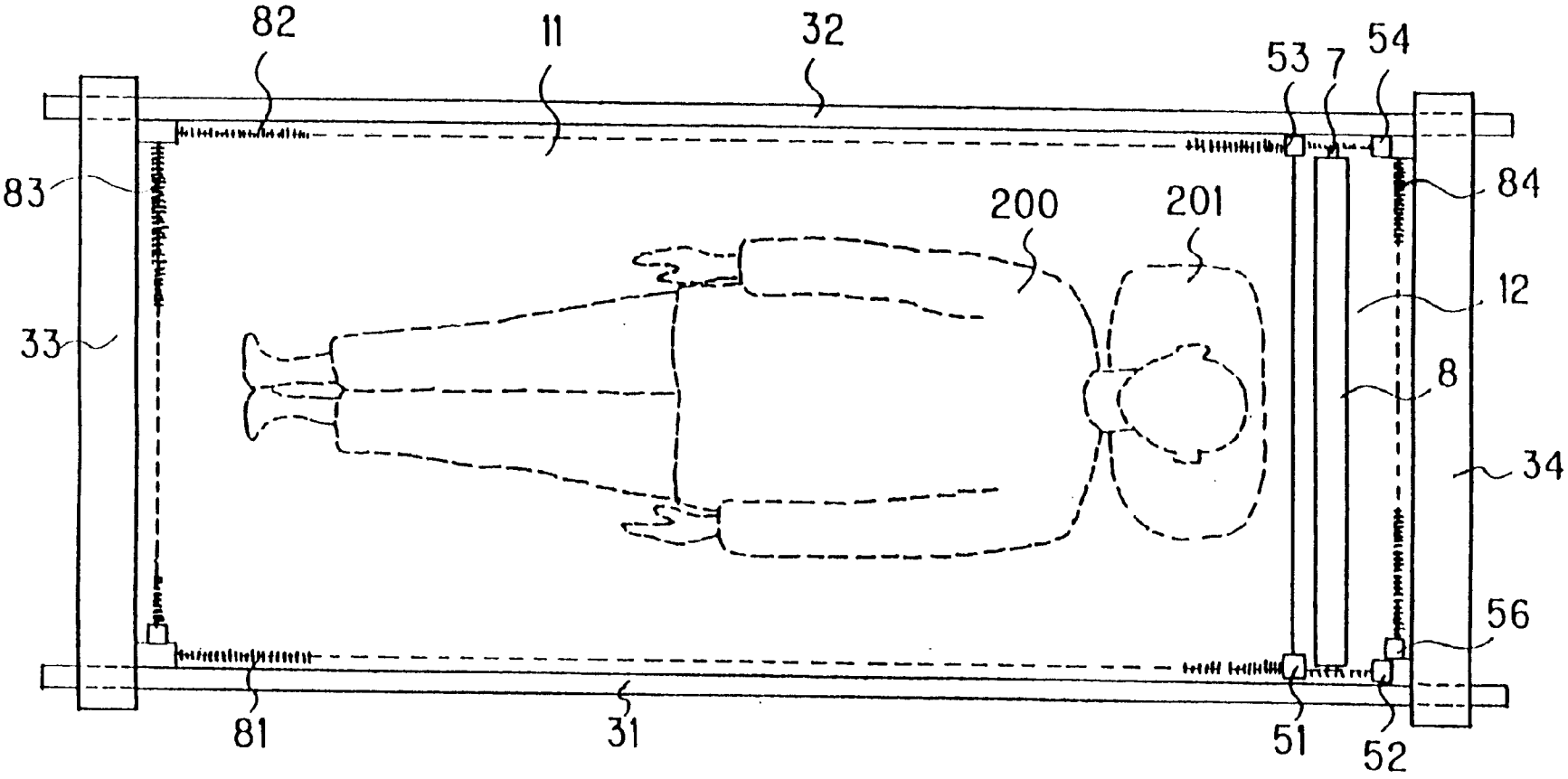

FIGS. 12(A) and 12(B) to FIG. 14 show the first embodiment of the present invention in a state thereof in which the mat 12 previously spread on the bedclothes spreading area has been taken up on the shaft 2 and in which the mat 11 which was wound on the shaft 1 has been paid out the same amount and spread on the bedclothes spreading area, FIG. 12(A) being a longitudinal sectional view, FIG. 12(B) a transversal sectional view, FIG. 13(A) a left side view, FIG. 13(B) a front view, and FIG. 14 a plan view.

Figure 15A:
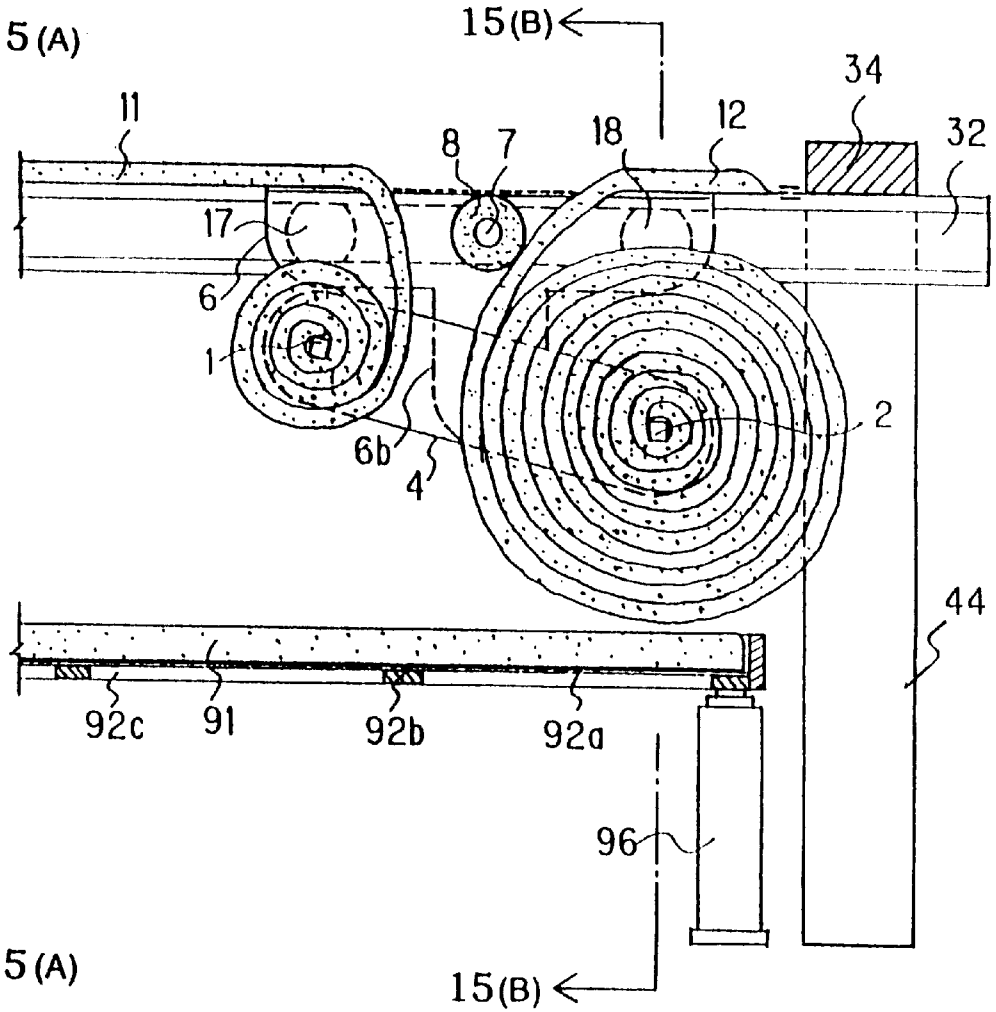
FIGS. 15(A) and 15(B) show an essential part of the bed according to the prcscnt invention in the state shown in FIGS. 12(A) and 12(B) to FIG. 14.
Figure 15B:
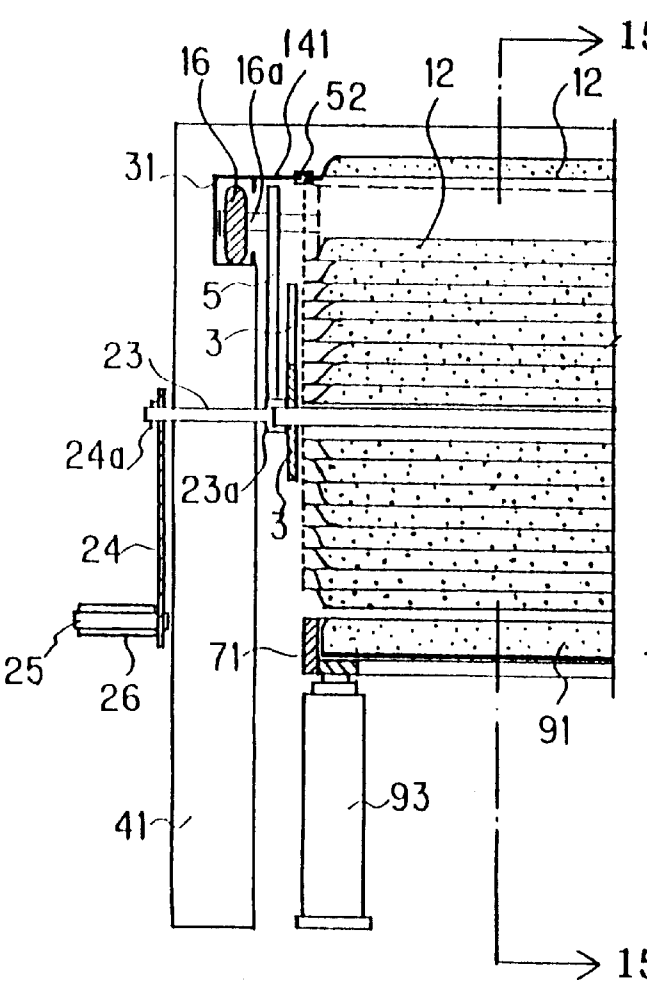

FIGS. 15(A) and 15(B) show an essential part of the bed according to the present invention in the state shown in FIGS. 12(A) and 12(B) to FIG. 14, FIG. 15(A) being a longitudinal sectional view, and FIG. 15(B) a transversal sectional view. FIGS. 16(A) and 16(B) also show an essential part of the bed according to the present invention in the state shown in FIGS. 12(A) and 12(B) to FIG. 14, FIG. 16(A) being a left side view, and FIG. 16(B) a front view.

The embodiment of the bed according to the present invention shown in FIGS. 1(A) and 1(B) to FIGS. 16(A) and 16(B), has the construction and functions to be described herein under.

The bed comprises rails 31 and 32, transversal or end frame members 33 and 34, legs 41 to 44, mats 11 and 12, fasteners 81 to 84, shafts 1 and 2, balancing members 3 and 4, a left carriage member 5, a right carriage member 6, wheels 15 to 18, a shaft 7, a cylindrical cushioning member 8, shafts 5*a* and 6*a*, and a lower support structure 9.

The left and tight carriage members 5 and 6, the wheels 15 to 18 and the shaft 7 constitute a carriage. The carriage supports the mats 11 and 12 via the balancing members 3 and 4 and the shafts 1 and 2, and guides the mats 11 and 12 along grooves 31*a* and 32*a* of the rails 31 and 32. The fastener 81 includes a fastener tape 141, a fastener teeth train 41 a tied to the fastener tape 141, and fastener teeth trains 11*f* and 12*f* tied to the mats 11 and 12 along one side thereof. The fastener 82 includes a fastener tape 142, a fastener teeth train 42*a* tied to the fastener tape 142 and fastener teeth trains 11*f* and 12*f* tied to the mats 11 and 12 along the other side thereof.

The rails 31 and 32 correspond to the first and second rails noted above. The grooves 31*a* and 32*a* correspond to the first and second guides noted above. The legs 41 to 44 correspond to the rail support means noted above. The mat 11 corresponds to the new bedclothes noted above, and the mat 12 corresponds to the old bedclothes noted above. The shafts 1 and 2 correspond to the first and second shafts noted above. The balancing members 3 and 4 correspond to the first and second balancing members noted above. The left and right carriage members 5 and 6, the wheels 15 to 18 and the shaft 7 constitute the carriage noted above. The shafts 5*a* and 6*a* correspond to the third and fourth shaft as noted above. The fasteners 81 and 82 correspond to the first and second fasteners noted above. The fastener tape 141 corresponds to one side fastener tape of the first fastener noted above. The fastener tape 142 corresponds to one side fastener tape of the second fastener noted above. Designated at 51 and 52 are slides which correspond to the first and second slides noted above. Designated at 5*c*, 5*d*, 6*c* and 6*d* correspond to the first to fourth slide couplers noted above.

The rectangular plan area shown enclosed by the fasteners 81 to 84 in FIG. 8 is the bedclothes spreading area in this embodiment of the bed. Referring to FIG. 8, the mat 12 is stretched between the rails 31 and 32 by the fasteners 81 and 82. The opposite ends of the mat 12 in the longitudinal direction thereof are tied by the fasteners 83 and 84 to the end frame members 33 and 34.

As is clearly shown in FIG. 4(B), the rail 32 is a steel member commonly termed a C-channel, having a cross-sectional profile resembling a capital letter C. The rail 31 has the same structure as the rail 32. The wheels 15 and 16 are guided along the groove 31*a* of the rail 31. The wheels 17 and 18 are guided along the groove 32*a* of the rail 32. The wheels 15 and 16 are rotatably supported on shafts of the left carrier member 5. The wheels 17 and 18 are rotatably supported on shafts of the right carriage member 6. The shaft which rotatably supports the wheel 16 is designated at 16*a* in FIG. 15(B). The left carriage member 5 has a downward extension 5*b*, and the right carriage member 6 has a downward extension 6*b*.

The downward extensions 5*b* and 6*b* carry shafts 5*a* and 6*a* rotatably mounted in them. The shafts 5*a* and 6*a* are aligned with each other. The balancing members 3 and 4 are rotatably coupled by the shafts 5*a* and 6*a* to the downward extensions 5*b* and 6*b*. The shafts 1 and 2 are rotatably mounted in the balancing members 3 and 4. The shafts 1 and 2 are parallel to each other. The shafts 1 and 2 have a length, which is set to be slightly smaller than the distance between the legs 41 and 43 and the distance between the legs 42 and 44.

The carriage, the balancing members 3 and 4 and the shafts 1 and 2 are assembled together as a single mechanism, which can be mounted in and detached from the rails 31 and 32. The shafts 1 and 2 can be mounted in and detached from the balancing members 3 and 4. To mount the mat 11, the shaft 1 is first removed from the balancing members 3 and 4, and then the mat 11 in the wound state is fitted on the shaft 1. When the mat 11 is supplied in the spread state, it can be wound on the shaft 1. The mat 11 is usually supplied in the state in which it is wound on the shaft 1 and together with the carriage, the balancing members 3 and 4 and the shafts 1 and 2.

The mats 1 and 12 are pieces of bedclothes having a structure as designated by reference numeral 10 in the sectional view of FIG. 5(A). The mats 11 and 12 have the same structure, and the mat 10 shown in FIG. 5(A) represent these mats 11 and 12. Likewise, fastener 8 represents the fasteners 81 to 84, slide Z represents the slides 51 to 56, fastener tape 140 represents the fastener tapes 141 to 144, rail 130 represents rails 31 and 32, carriage member W represents the carriage members 5 and 6, and slide coupler Y represents the slide couplers 5*c*, 5*d*, 6*c* and 6*d*.

The mat 10 includes a lower stretched sheet 10*a*, cotton 10*b* as cushioning material, an upper stretched sheet 10*c*, fasteners 10*d* fastening together the cotton 10*b* and the lower stretched sheet 10*a*, fasteners 10*e* fastening together the upper and lower stretched sheets 10*c* and 10*a*, and fastener teeth trains 10*f* tied to edges of the lower stretched sheet 10*a*. Each fastener 8 includes the fastener tape 140 and the fastener teeth trains 4*a* and 10*f*. The fastener teeth trains 4*a* and 10*f* are meshed or de-meshed with one another with the process of sliding the slide Z.

Each slide Z is coupled to each slide coupler Y, which is integral with each carriage member W, so that the fastener teeth trains 4*a* and 10*f* are meshed or de-meshed with the sliding progress of each carriage member W.

Figure 16:
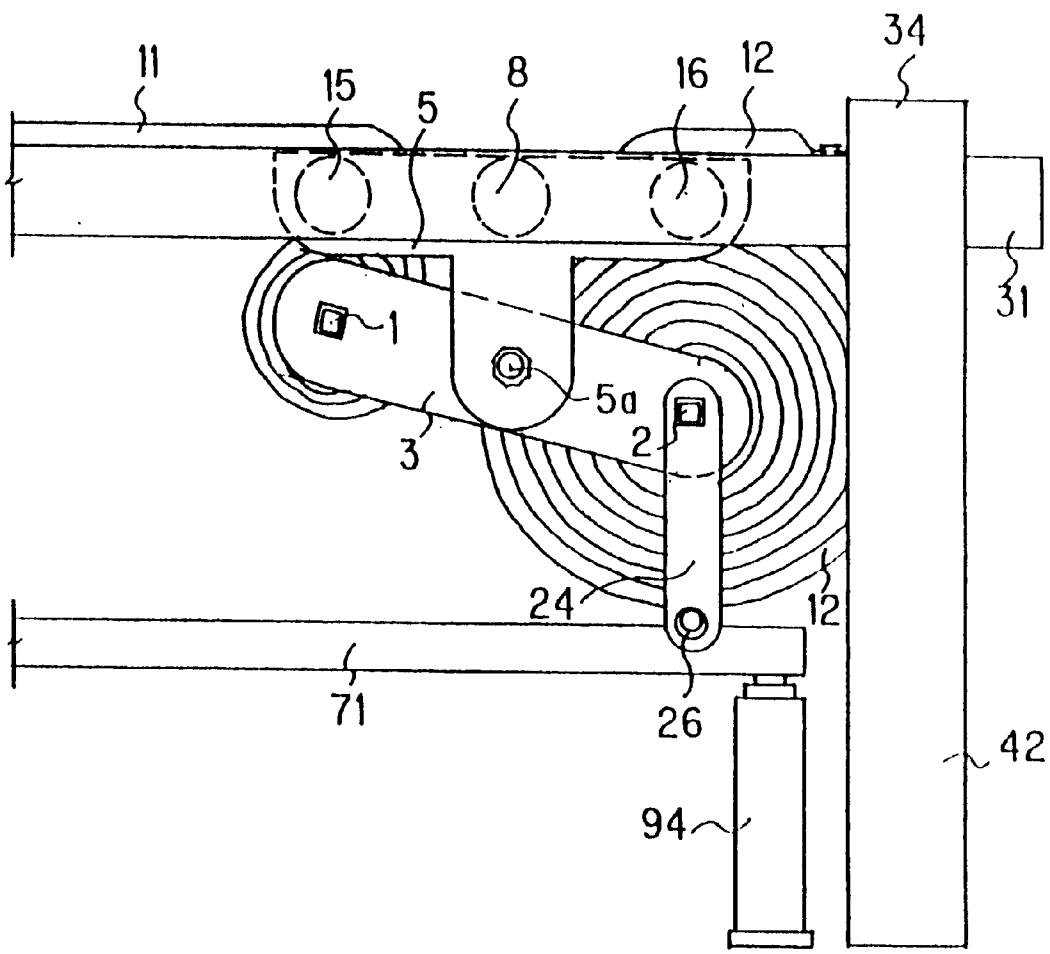
FIGS. 16(A) and 16(B) also show an essential part of the bed according to the present invention in the state shown in FIGS. 12(A) and 12(B) to FIG. 14.
Figure 16:
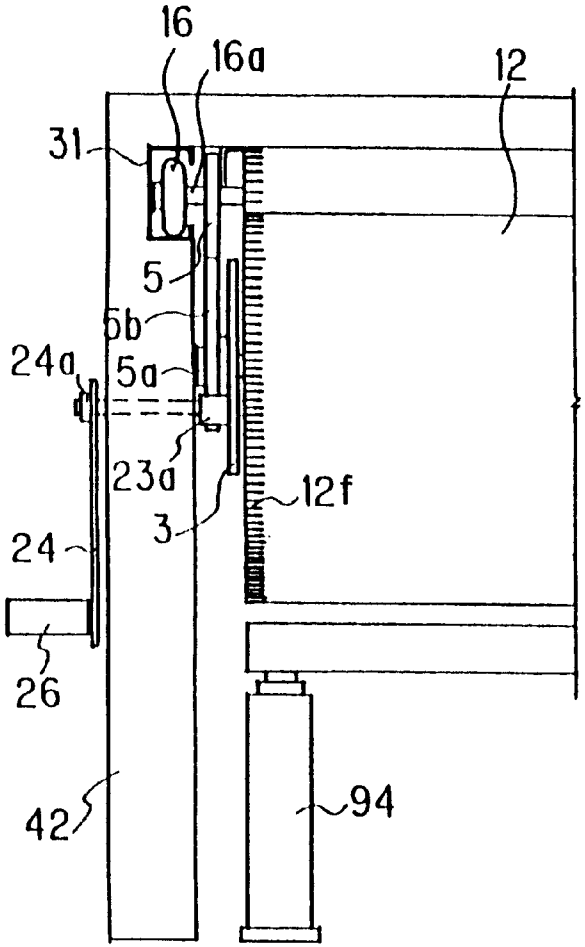

As shown in FIGS. 15(B) and 16(13), a torque can be applied to the shaft 2 via a recessed end 23*a* fitted thereon, whereby the shaft 2 can be rotated. The recessed end 23*a* is the end of a shaft 23 which is fitted at the other end in a crank arm 24. The crank arm 24 is non-rotatably secured to the shaft 23 by a crank arm retainer 24*a*. The shaft 2 can be rotated by manually turning a grip 26 about the shaft 23.

The operation of exchanging the mat 12, shown in FIGS. 6(A) and 6(B) to FIG. 8, which is the old bedclothes for the mat 11 which is the new bedclothes will now be described.

The lower support structure 9 includes oil hydraulic lifts 93 to 96 supporting a mattress support plate structure 92 and a mattress 91. Frame members 71 to 74 support the mattress 91 on the mattress support plate structure 92. The mattress support plate structure 92 includes a plate 92*a* having the same plan area as the bedclothes spreading area, and a plurality of transversal and longitudinal beams 92*b* and 92*c*. Before changing the mat 12, the mattress support plate structure 92 and the mattress 91 are lowered down to a height as shown in FIGS. 9(A) and 9(B) by operating the oil hydraulic lifts 93 to 96. This is done so because the mat 11 wound on the shaft 1 and the carriage should be held underneath the mat 12, which is to be replaced with the mat 11.

As described before, the mat 11 is supplied in the state in which it is wound on the shaft 1 together with the carriages the balancing members 3 and 4 and the shafts 1 and 2. Then, the wheels 15 and 16 of the carriage are fitted in the groove 31*a* of the rail 31, and the wheels 17 and 18 in the groove 32*a* of the rail 32. The shaft 2 has a fastener tape and a fastener teeth train secured to it. In the state shown in FIGS. 6(A) and 6(B) to FIG. 8, the end of the mat corresponding to the end frame member 33 is secured by the fastener 83 thereto. The fastener 83 is unfastened by manually advancing the slide 55, and then the fastener teeth train at the end of the mat 12 corresponding to the end frame member, which is the leading end when changing the bedclothes, is meshed with the fastener teeth train secured to the shaft 2, thus tying the leading end of the mat 12 to the shaft 2. The leading end of the mat is tied to the shaft 2 by manually advancing the fastener slide.

The outermost end of the wound mat 11 is the leading end when changing the bedclothes. This leading end also has a fastener teeth train tied to it. The fastener teeth train tied to the leading end of the mat 11 is meshed with the fastener teeth train secured to the end frame member 33 via the fastener tape 143, by manually advancing the slide 55.

In this state, the mat 12 is wound on the shaft 2 by turning the grip 26, causing the shaft 2 to respond by pulling and winding the mat 12. With this force, the shaft 2 is advanced in unison with the balancing members 3 and 4, the carriage members 5 and 6, the shaft 7 and the cylindrical cushioning member 8 along the rails 31 and 32 toward the end frame member 34.

The advancement of the shaft 2 also causes advancement of the slide 51 to 54, thus stretching the mat 11 between the fasteners 81 and 82 and causing the mat 12 to be released from the fasteners 81 and 82 and wound on the shaft 2.

The state when the mat 12 approaches the end frame member 34 is shown in detail in FIG. 15(A). In this state, the mat 12 is released from the fasteners 81 and 82 by manually advancing the slides 52 and 54, and then the fastener 84 is unfastened by manually advancing the slide 56, thus perfectly taking up the mat 12 on the shaft 2. Then, the mat 11 is fully stretched between the fasteners 81 and 82 by manually advancing the slides 51 and 53, and the fastener teeth train tied to the trailing end of the mat 11 is tied to the end frame member 34 with the fastener 84.

The mat 12 can be removed from the bed in its state wound on the shaft 2 together with the carriage, the balancing members 3 and 4 and the shafts 1 and 2 by removing the wheels 15 to 18 from the grooves 31*a* and 32*a*. The removed mat 12 is taken out from the shaft 2 by removing the shaft 2 from the balancing members 3 and 4, so that it may be brought to laundry for washing.

The mat 12 is exchanged for the mat 11 in the manner as described above. During the change, the patient 200 remains laid on the bed and need not be moved at all. The shaft 7 is rotatably coupled to the carriage members 5 and 6, and the cylindrical cushioning member 8 which is in the form of sponge is fitted on the shaft 7. During the change of the bedclothes, a slight free space is generated between the mats 11 and 12. However, the cylindrical cushioning member 8 always occupies a central part of this free space, so that the patient 200 will not experience a gap in the support of his or her body throughout the mat changing process.

While the mat 12 is taken up on the shaft by the rotation thereof it experiences pulling force or tension. The reaction force due to this tension causes the balancing members 3 and 4 to be changed in position from the position shown in FIGS. 9(A) and 9(B) via the position shown in FIGS. 1(A) and 1(B) to the position shown in FIGS. 12(A) and 12(B). As the carriage position changes along the rails, the balancing members 3 and 4 gradually change their inclination according to the turns of the mats 11 and 12 wound on the shafts 1 and 2. Thus, the mats 11 and 12 maintain their naturally curved form as they are paid out or taken up on the shafts 1 and 2. This means that the free space formed between the mats 1 and 12 is small, thus requiring little torque to be produced by the crank arm 24 for winding. Also, the mats 11 and 12 can be paid out or taken up without damage thereto.

When the mat 11 has been stretched between the fasteners 81 and 82, the mattress support plate structure 92 and the mattress 91 are lifted by the oil hydraulic lifts 93 to 96 in the lower support structure 9 and supported from below. The mattress 91 is thicker than the mat 11, and can provide flat and soft cushioning to the patient 200. The lower support structure 9 is not an essential feature of the present embodiment. With only mat 11 or 12 underneath the patient, sagging of a central portion of the mat due to the weight of the patient 200 is inevitable. The mattress 91 is also convenient to provide heat preservation and additional cushioned support. It is thus suitable to provide the lower support structure 9.

Figure 17A:
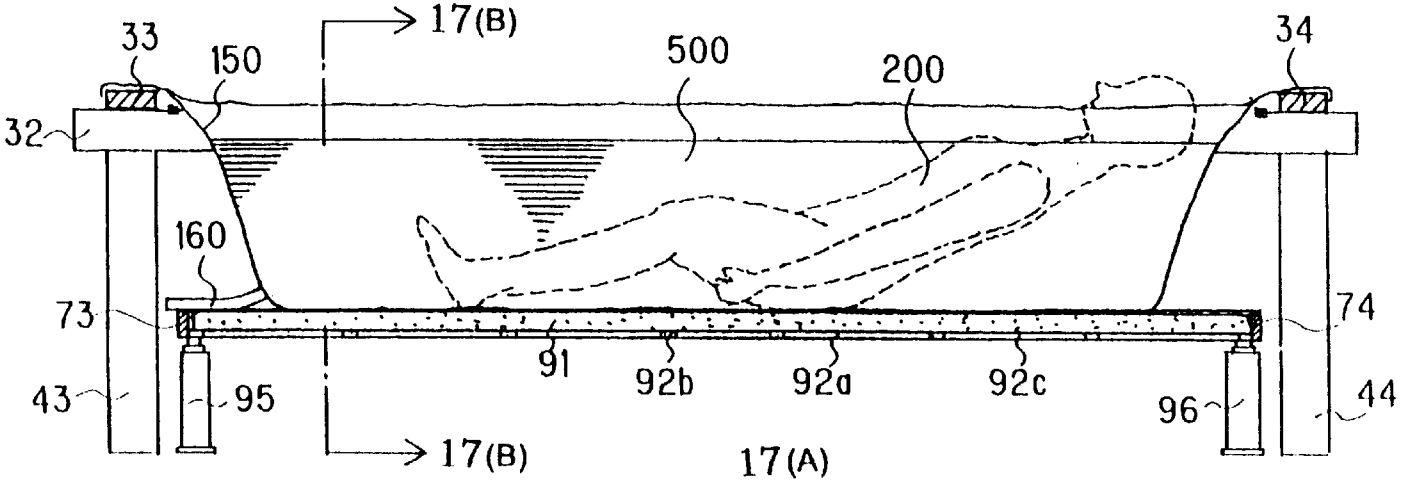
Figure 17B:
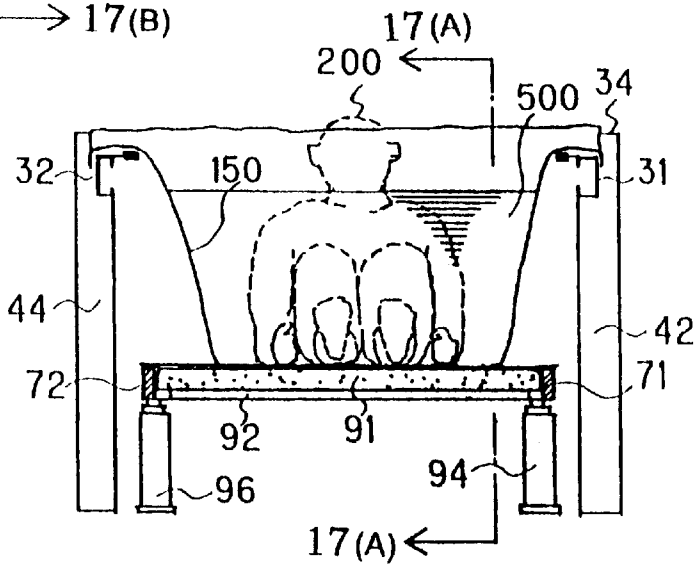

The embodiment of the present invention as described above, is by no means limiting. FIGS. 17(A) and 17(B) show a different embodiment of the present invention. This embodiment is a convertible bed that it can be converted from a bed, on which the patient 200 is laid to a bath tub filled with hot water 500, in which the patient 200 is dipped. To obtain the configuration of the bath tub, the mat 11 is covered beforehand with a sheet 150 of vinyl chloride or like material, and spread together with the sheet 150 covering it under the patient 200. Then, the bottom of the mat 11 is supported with the lower support structure 9. Then, the fasteners 81 to 84 of the mat 11 are unfastened, and the mat 11 itself is removed from the rails 31 and 32 and the end frame members 33 and 34. Then, the edges of the sheet 150 are tied by clips or like tying means to the rails 31 and 32 and the end frame members 33 and 34. Then, the lower support structure 9 is lowered, and in this state hot water 500 is poured into the bath tub thus formed by the sheet 150 to a depth of 40 centimeters. Designated at 160 is a draining pipe.

The height h of the edges of the sheet 150 from the bottom thereof in this arrangement is at least 20 centimeters. The sheet 150 has such a size that its edges tied by the tying means is held above the plane of the fasteners 81 to 84 (the plane of the bedclothes spreading area).

Figures 18A, 18B:
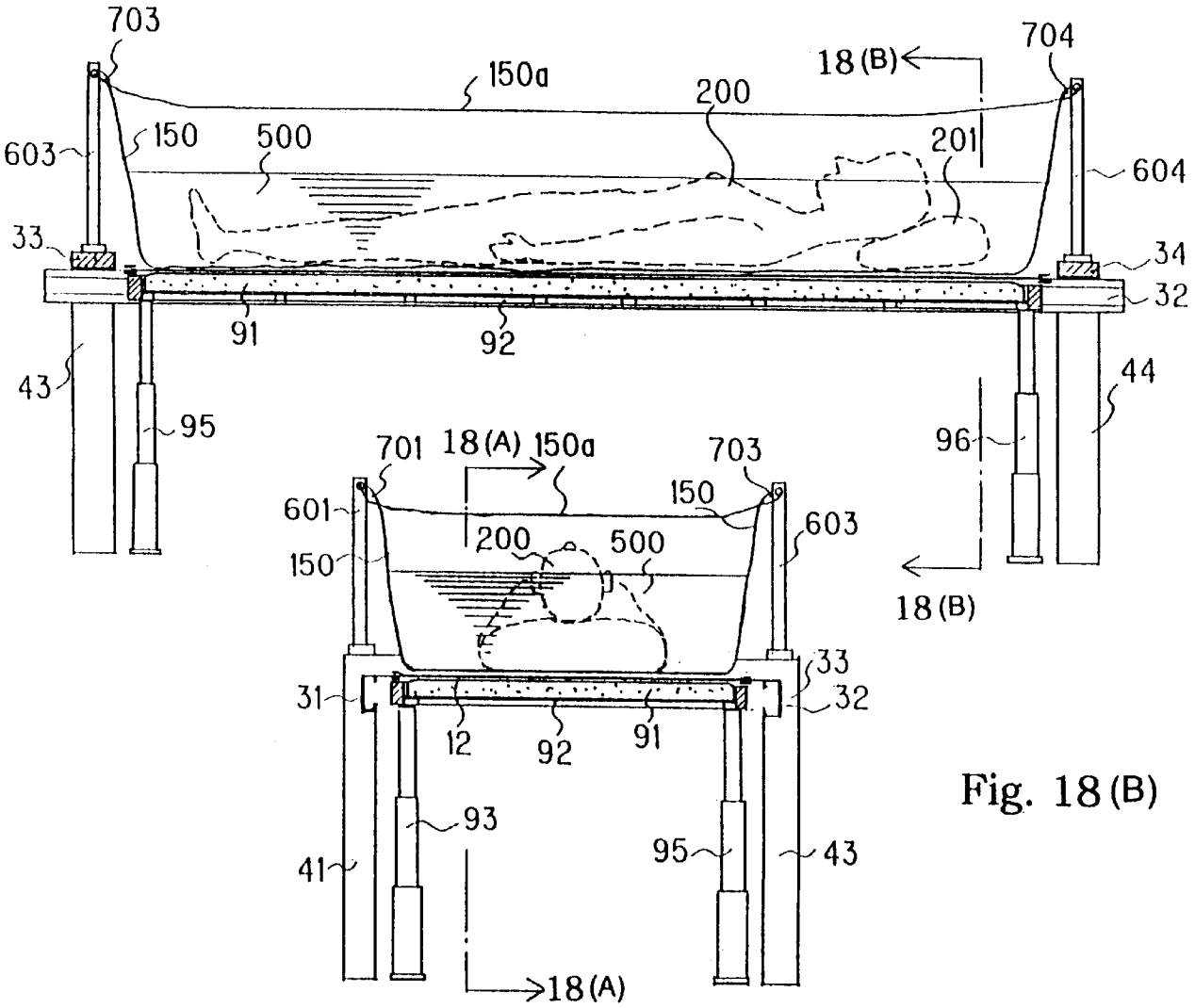

FIGS. 18(A) and 18(B) show a further embodiment which is again a convertible bed. In this embodiment, like the preceding embodiment shown in FIGS. 17(A) and 17(B), the mat is covered beforehand with sheet 150, and the edges thereof are held at a high level by support posts 601 to 604 and hooks 701 to 704. Hot water 500 is poured to a depth of 25 centimeters to complete the bath. The support posts 601 to 604 have a height of 50 centimeters. The support posts 601 to 604 are detachably secured to the rails 31 and 32 via the end frame members 33 and 34. The sheet 150 has such a size that its edges 150*a* hooked by the hooks 701 to 704 are held at a constant height H (of at least 20 centimeters) from the plane of the fasteners 81 to 84 (i.e., the plane of the bedclothes spreading area).

As has been described in the foregoing, according to the present invention it is possible to provide a bed which permits readily spreading bedclothes over it without substantial burden for either the patient or the care-taker.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A bed which permits changing of bedclothes on a bedclothes spreading area having a length and a width without moving a person on the bed, comprising:

a first shaft on which new bedclothes are to be wound thereon such that a leading end of the new bedclothes is an outermost free end;

a second shaft for taking up old bedclothes from a leading end of the old bedclothes;

a shaft holding means for holding the first and second shafts underneath the bedclothes spreading area such that the shafts are independently rotatable and are positioned so as to be parallel to each other and spaced apart by a predetermined distance;

guiding means for guiding the shaft holding means along a first guide and a second guide parallel to the first guide extending under and on opposite sides of the bedclothes spreading area;

stretching means supported inside the first and second guides by the guiding means, for detachably spreading bedclothes over the bedclothes spreading area; and rotating means for rotating the second shaft, wherein when the leading end of the old bedclothes is tied to the second shaft and the leading end of the new bedclothes is held stretched in the stretching means, and a pulling force is then applied to the old bedclothes by rotating the second shaft with the rotating means, the old bedclothes are wound on the second shaft, while the shaft holding means is caused to be moved along the guides, thereby causing the new bedclothes to be rolled out from the first shaft to be spread and stretched by the stretching means over an empty area formed in the bedclothes spreading area as the old bedclothes are wound on the second shaft.

2. The bed according to claim 1, wherein:

the first guide and the second guide comprise a first rail and a second rail, respectively, the first and second rails having a length greater than the length of the bedclothes spreading area;

the guiding means includes a rail support means supporting the rails, the rail support means supporting the first and second guides such that the guides are located just outside of and parallel to the length of the bedclothes spreading area and spaced apart at a distance greater than the width of the bedclothes spreading area;

the shaft holding means includes a carriage and a first balancing member and a second balancing member;

the carriage includes a first carriage member which is guided along the first guide, and a second carriage member which is guided along the second guide;

further comprising a third shaft having a longitudinal axis, the first balancing member being coupled by a rotational coupling to the first carriage member such as to be pivotal about the third shaft, the longitudinal axis of which is horizontal and perpendicular to the length of the bedclothes spreading area;

further comprising a fourth shaft having a longitudinal axis aligned with the axis of the third shaft, the second balancing member being coupled by a rotational coupling to the second carriage member such as to be pivotal about the fourth shaft, and being coupled by the first and second shafts to the first balancing member, the first and second shafts being spaced apart and parallel to the third shaft; and wherein the stretching means comprises at least one fastener.

3. The bed according to claim 2, wherein:

the at least one fastener includes a first fastener formed in proximity to the first guide and a second fastener formed in proximity to the second guide;

the first fastener includes a fastener tape having a fastener teeth train and is secured to the first rail and also includes another fastener tape having a fastener teeth train and is secured to or formed along an edge of each of the new and old bedclothes;

the second fastener includes a fastener tape having a fastener teeth train secured to the second rail and another fastener tape having a fastener teeth train secured to or formed along an edge of each of the new and old bedclothes;

a first slide and a second slide are coupled via a first slide coupler and a second slide coupler, respectively, to the first carriage member;

a third slide and a fourth slide are coupled via a third slide coupler and a fourth slide coupler, respectively, to the second carriage member;

the first slide meshes together the fastener teeth trains of the fastener tapes secured to the first rail and the old bedclothes as the first carriage member is advanced along the first guide by the pulling force applied to the old bedclothes;

the second slide de-meshes the fastener teeth trains of the fastener tapes of the first fastener secured to the first rail and the new bedclothes as the first carriage member is advanced along the first guide;

the third slide meshes together the fastener teeth trains of the fastener tapes of the second fastener secured to the second rail and the old bedclothes as the second carriage member is advanced along the second guide by the pulling force applied to the old bedclothes; and the fourth slide de-meshes the fastener teeth trains of the fastener tapes of the second fastener secured to the second rail and the new bedclothes as the second carriage member is moved along the second guide.

4. The bed according to claim 1, further comprising a lower support structure provided underneath the bedclothes spreading area, wherein the lower support structure includes a mattress having substantially a length and a width equal to the length and the width of the bedclothes spreading area, a mattress support structure for supporting a bottom surface of the mattress, and lifting means for vertically moving the mattress support structure, wherein the lifting means is able to vertically move the mattress support structure while maintaining the mattress in a horizontal position, and wherein a distance moved by a top surface of the mattress in vertical movement thereof caused by the lifting means via the mattress support structure covers at least a range between a bottom surface of old bedclothes stretched over the bedclothes spreading area and a lower surface of the new bedclothes wound on the first shaft.

5. The bed according to claim 3, wherein:

the carriage includes a fifth shaft parallel to the first shaft and a cylindrical cushioning member enclosing the fifth shaft;

the first shaft couples together the first and second carriage members; and the fifth shaft is disposed at a position such that a top surface of the cushioning member occupies a central part of a free space formed between the old and new bedclothes in the bedclothes spreading area while the first and second carriage members are advanced along the first and second guides.

6. The bed according to claim 3, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on opposite ends of the first and second rails.

7. The bed according to claim 2, further comprising a lower support structure provided underneath the bedclothes spreading area, wherein the lower support structure includes a mattress having substantially a length and a width equal to the length and the width of the bedclothes spreading area, a mattress support structure for supporting a bottom surface of the mattress, and lifting means for vertically moving the mattress support structure, wherein the lifting means is able to vertically move the mattress support structure while maintaining the mattress in a horizontal position, and wherein a distance moved by a top surface of the mattress in vertical movement thereof caused by the lifting means via the mattress support structure covers at least a range between a bottom surface of old bedclothes stretched over the bedclothes spreading area and a lower surface of the new bedclothes wound on the first shaft.

8. The bed according to claim 3, further comprising a lower support structure provided underneath the bedclothes spreading area, wherein the lower support structure includes a mattress having substantially a length and a width equal to the length and the width of the bedclothes spreading area, a mattress support structure for supporting a bottom surface of the mattress, and lifting means for vertically moving the mattress support structure, wherein the lifting means is able to vertically move the mattress support structure while maintaining the mattress in a horizontal position, and wherein a distance moved by a top surface of the mattress in vertical movement thereof caused by the lifting means via the mattress support structure covers at least a range between a bottom surface of old bedclothes stretched over the bedclothes spreading area and a lower surface of the new bedclothes wound on the first shaft.

9. The bed according to claim 4, wherein:

the carriage includes a fifth shaft parallel to the first shaft and a cylindrical cushioning member enclosing the fifth shaft;

the first shaft couples together the first and second carriage members; and the fifth shaft is disposed at a position such that a top surface of the cushioning member occupies a central part of a free space formed between the old and new bedclothes in the bedclothes spreading area while the first and second carriage members are advanced along the first and second guides.

10. The bed according to claim 7, wherein:

the carriage includes a fifth shaft parallel to the first shaft and a cylindrical cushioning member enclosing the fifth shaft;

the first shaft couples together the first and second carriage members; and the fifth shaft is disposed at a position such that a top surface of the cushioning member occupies a central part of a free space formed between the old and new bedclothes in the bedclothes spreading area while the first and second carriage members are advanced along the first and second guides.

11. The bed according to claim 8, wherein:

the carriage includes a fifth shaft parallel to the first shaft and a cylindrical cushioning member enclosing the fifth shaft;

the first shaft couples together the first and second carriage members; and the fifth shaft is disposed at a position such that a top surface of the cushioning member occupies a central part of a free space formed between the old and new bedclothes in the bedclothes spreading area while the first and second carriage members are advanced along the first and second guides.

12. The bed according to claim 4, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

13. The bed according to claim 7, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

14. The bed according to claim 8, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

15. The bed according to claim 5, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

16. The bed according to claim 9, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

17. The bed according to claim 10, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

18. The bed according to claim 11, further comprising:

a sheet of a liquid-tight material for covering a top surface of the new bedclothes and being spread together with the new bedclothes on the bedclothes spreading area, and securing means for securing edges of the sheet spread on the bedclothes spreading area to the first and second rails;

the sheet having a size such that when secured by the securing means, the edges of the sheet can be held at a level of the bedclothes spreading area in a second configuration transformed from a first configuration;

the first configuration being achieved by lifting the mattress with the lower support structure until a top surface of the mattress comes to a position to support the bottom surface of the new bedclothes spread on the bedclothes spreading area, then securing the edges of the sheet spread on the top of the new bedclothes to the first and second rails with the securing means, and then unfastening the first and second fasteners;

the second configuration being achieved by forming a recess-like a bathtub with the sheet by lowering the mattress via the lower support structure such that a bottom surface of the sheet is positioned at least 20 centimeters below the bedclothes spreading area.

19. The bed according to claim 4, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

20. The bed according to claim 7, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support costs having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

21. The bed according to claim 8, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

22. The bed according to claim 5, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

23. The bed according to claim 9, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

24. The bed according to claim 10, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

25. The bed according to claim 11, further comprising:

a sheet of liquid-tight material for covering a top surface of the new bedclothes and being spread together with the new bedclothes on the bedclothes spreading area;

sheet edge supporting means for supporting edges of the sheet spread on the top surface of the new bedclothes at a level of at least 20 centimeters above the bedclothes spreading area, the sheet edge supporting means including first through fourth support posts having stem members secured to opposite ends of the first and second rails; and securing means for securing edges of the sheet to upper ends of each of the first through fourth support posts;

the first through fourth support posts each having a height of at least 20 centimeters and being capable of being detachably mounted on the opposite ends of the first and second rails.

* * * * *